US010672597B2

(12) United States Patent
Maze et al.

(10) Patent No.: US 10,672,597 B2
(45) Date of Patent: Jun. 2, 2020

(54) CALIBRATING ELECTRON MULTIPLIER GAIN USING THE PHOTOELECTRIC EFFECT

(71) Applicant: Thermo Finnigan LLC, San Jose, CA (US)

(72) Inventors: Joshua T. Maze, Round Rock, TX (US); Edward B. McCauley, Cedar Park, TX (US); Scott T. Quarmby, Round Rock, TX (US)

(73) Assignee: THERMO FINNIGAN LLC, San Jose, CA (US)

( * ) Notice: Subject to any disclaimer, the term of this patent is extended or adjusted under 35 U.S.C. 154(b) by 6 days.

(21) Appl. No.: 16/032,782

(22) Filed: Jul. 11, 2018

(65) Prior Publication Data

US 2020/0020513 A1 Jan. 16, 2020

(51) Int. Cl.

| | |
|---|---|
| ***H01J 49/00*** | (2006.01) |
| ***H01J 43/16*** | (2006.01) |
| ***H01J 43/10*** | (2006.01) |
| ***H01J 49/42*** | (2006.01) |
| ***H01J 49/02*** | (2006.01) |
| ***H01J 49/40*** | (2006.01) |

(52) U.S. Cl.

CPC ..... *H01J 43/16* (2013.01); *H01J 43/10* (2013.01); *H01J 49/0009* (2013.01); *H01J 49/025* (2013.01); *H01J 49/40* (2013.01); *H01J 49/4225* (2013.01)

(58) Field of Classification Search

CPC ..... H01J 49/00; H01J 49/02; H01J 49/025; H01J 49/26; H01J 43/00; H01J 43/04; H01J 43/06; H01J 43/10; H01J 43/16

USPC ..... 250/281, 282, 299, 300

See application file for complete search history.

(56) References Cited

U.S. PATENT DOCUMENTS

| | | | |
|---|---|---|---|
| 3,898,456 | A | 8/1975 | Dietz |
| 4,988,868 | A | 1/1991 | Gray |
| 5,773,822 | A | 6/1998 | Kitamura et al. |

(Continued)

FOREIGN PATENT DOCUMENTS

| | | | |
|---|---|---|---|
| EP | 2899746 | A1 | 7/2015 |
| EP | 3018694 | A1 | 5/2016 |
| WO | 2016/160789 | A1 | 8/2019 |

OTHER PUBLICATIONS

Friedman et al., "Low background-rate detector for 40-keV ions using a conversion dynode and a microchannel-plate electron multiplier to reject low-energy ions, electrons, and photons", Rev. Sci. Instrum. 59 (1), 1988, pp. 98-111.

*Primary Examiner* — Jason L McCormack
(74) *Attorney, Agent, or Firm* — David A. Schell

(57) ABSTRACT

An ion detector includes a first stage dynode configured to receive an ion beam and generate electrons, a photon source arranged to provide photons to the first stage dynode, the photons of sufficient energy to cause the first stage dynode to emit photoelectrons, an electron multiplier configured to receive the electrons or the photoelectrons from the first stage dynode and generate an output proportional to the number of electrons or photoelectrons, and a controller. The controller is configured to receive the output generated in response to the photoelectrons; calculate a gain curve of the detector based on the output; and set a voltage of the electron multiplier or the first stage dynode to achieve a target gain for the ion beam.

22 Claims, 4 Drawing Sheets

(56) References Cited

U.S. PATENT DOCUMENTS

| | | | | |
|---|---|---|---|---|
| 6,087,656 | A | 7/2000 | Kimmich et al. | |
| 7,157,681 | B1 | 1/2007 | Tetzlaff | |
| 7,745,781 | B2 | 6/2010 | Steiner | |
| 2006/0080045 | A1 | 4/2006 | Steiner | |
| 2011/0095177 | A1 | 4/2011 | Giannakopulos | |
| 2013/0187057 | A1 | 7/2013 | Kobayashi et al. | |
| 2014/0151549 | A1* | 6/2014 | Steiner | H01J 9/025 250/288 |
| 2019/0252167 | A1 | 8/2019 | VanGordon | |
| 2019/0362954 | A1 | 11/2019 | Shichi | |

* cited by examiner

CALIBRATING ELECTRON MULTIPLIER GAIN USING THE PHOTOELECTRIC EFFECT

FIELD

The present disclosure generally relates to the field of mass spectrometry including calibrating electron multiplier gain using the photoelectric effect.

INTRODUCTION

Mass spectrometry (MS) is widely used for identifying and quantifying compounds in a sample. In mass spectrometry, ions are separated according to their mass/charge (m/z) ratios, and ion abundances are measured as a function of m/z. Generally, a mass spectrometer has three major components; an ion source for producing ions, a mass analyzer for separating ions by m/z, and a detector for detecting the m/z separated ions. In an exemplary embodiment, the detector can include a first stage dynode for generating electrons responsive to the impingement of positive ions thereon, an electron multiplier for amplifying the electrons released from the first stage dynode to produce a detectable and measurable current, and an electrometer for measuring and recording the detected current.

Generally, the sensitivity of the electron multiplier can degrade over the lifetime of the ion multiplier. Periodic recalibration of the electron multiplier can be necessary to maintaining the sensitivity and accuracy of the ion detector.

Determining the gain on the electron multiplier is traditionally done by sending an ion beam through the instrument and blocking the beam such that a very low flux of ions hit the detector. The key is determining the input number of ions which can be done in a variety of ways. In some implementations, the routine looks for individual ions hitting the detector to calculate the gain of the circuitry. In other implementations, the routine looks at the stability of the ion beam and uses ion statistics to calculate the initial intensity of the ion beam. Once a known input of ions is determined, the output signal is measured at a variety of cathode voltages and used to determine the gain-to-voltage relationship for the detector.

However, there can be problems with effectively determining the initial ion input signal. An unstable ion source, for instance, can give falsely low inputs when using the signal stability to calculate the ion counts. When using the single ion event method, very small amounts of charging in the ion stack can make it difficult to obtain a low enough signal flux over the entire gain calibration routine's run. Field emission of charged particles from dust also cause incorrect gain measurements. More challenging is the situation where the starting voltages for the electron multiplier and the instrument calibrations are such that there are insufficient ions supplied to the detector to be detected. It can be impossible to perform the gain calibration of the detector without a sufficient ion beam, and it can be impossible to tune the ion beam without a measurable signal from the detector. From the foregoing, it will be appreciated that a need exists for improved systems and methods for gain calibration of an electron multiplier.

SUMMARY

In a first aspect, an ion detector can include a first stage dynode configured to receive an ion beam and generate electrons; a photon source arranged to provide photons to the first stage dynode; an electron multiplier configured to receive the electrons or the photoelectrons from the first stage dynode and generate an output proportional to the number of electrons or photoelectrons; and a controller. The photons can be of sufficient energy to cause the first stage dynode to emit photoelectrons. The controller can be configured to receive the output generated in response to the photoelectrons; calculate a gain curve of the detector based on the output; and set a voltage of the electron multiplier or the first stage dynode to achieve a target gain for the ion beam.

In various embodiments of the first aspect, the photon source can be a light emitting diode, a laser, a discharge lamp, and the like. In particular embodiments, the light emitting diode can be an ultraviolet light emitting diode.

In various embodiments of the first aspect, the ion detector can further include a photodiode configured to measure the photon output of the photon source. In particular embodiments, the controller can be further configured to adjust the current supplied to the photon source in response to the measured photon output.

In various embodiments of the first aspect, the controller can be further configured to obtain a second output with a different current supplied to the photon source or a different voltage of the electron multiplier, and the calculated gain curve can be further based on the second output.

In various embodiments of the first aspect, a mass spectrometer can include the ion detector.

In a second aspect, a method for calibrating an ion detector can include providing photons to a low work function material. The photons can have sufficient energy to cause the low work function material to emit photoelectrons. The method can further include generating an output proportional to the number of photoelectrons using an electron multiplier; calculating a gain curve for the detector based on the output proportional to the number of photoelectrons; setting a voltage of the electron multiplier based on the gain curve; directing an ion beam to a first stage dynode, the ions having sufficient energy to cause the first stage dynode to emit electrons; obtaining an output from the electron multiplier; and determining a number of ions in the ion beam based on the output from the electron multiplier.

In various embodiments of the second aspect, the photons can be generated with a photon source. In particular embodiments, the photon source can be a light emitting diode, a laser, or a discharge lamp. In particular embodiments, the light emitting diode can be an ultraviolet light emitting diode.

In various embodiments of the second aspect, the output of the photon source can be measured using a photodiode. In particular embodiments, the current supplied to the photon source can be adjusted in response to the measured photon output.

In various embodiments of the second aspect, providing the photons to the low work function material can include providing photons to the first stage dynode, and the first stage dynode can include the low work function material.

In various embodiments of the second aspect, the method can include obtaining a second output with a different current supplied to the photon source or a different voltage of the electron multiplier, wherein calculating the gain curve can be further based on the second output.

In a third aspect, an ion detector can include a first stage dynode configured to receive an ion beam and generate electrons; a low work function material; a photon source arranged to provide photons to the low work function material, an electron multiplier configured to receive the electrons from the first stage dynode or the photoelectrons from the low work function material and generate an output proportional to the number of electrons or photoelectrons; and a controller. The photons can be of sufficient energy to cause the low work function material to emit photoelectrons. The controller can be configured to receive the output generated in response to the photoelectrons; calculate a gain curve of the detector based on the output; and set a voltage of the electron multiplier or the first stage dynode to achieve a target gain for the ion beam.

In various embodiments of the third aspect, the photon source can be a light emitting diode. In particular embodiments, the light emitting diode can be an ultraviolet light emitting diode.

In various embodiments of the third aspect, the ion detector can further include a photodiode configured to measure the photon output of the photon source. In particular embodiments, the controller can be further configured to adjust the current supplied to the photon source in response to the measured photon output.

In various embodiments of the third aspect, the controller can be further configured to obtain a second output with a different current supplied to the photon source or a different voltage of the electron multiplier, and the calculated gain curve can be further based on the second output.

In various embodiments of the third aspect, a mass spectrometer can include the ion detector.

DRAWINGS

For a more complete understanding of the principles disclosed herein, and the advantages thereof, reference is now made to the following descriptions taken in conjunction with the accompanying drawings and exhibits, in which.

Figure 1:
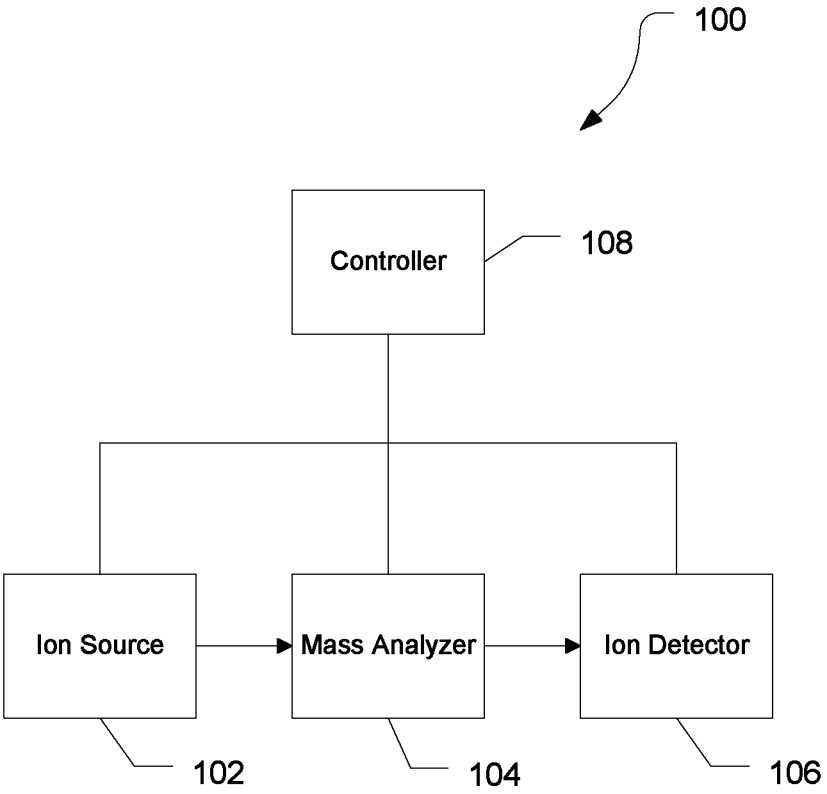
FIG. 1 is a block diagram of an exemplary mass spectrometry system, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for ion isolation are described herein and in the accompanying exhibits.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, voltages, currents, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass to charge ratio of the ions. For example, the mass analyzer 104 can include a quadrupole mass filter analyzer, a quadrupole ion trap analyzer, a time-of-flight (TOF) analyzer, an electrostatic trap (e.g., ORBITRAP) mass analyzer, Fourier transform ion cyclotron resonance (FT-ICR) mass analyzer, and the like. In various embodiments, the mass analyzer 104 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio.

In various embodiments, the ion detector 106 can detect ions. For example, the ion detector 106 can include an electron multiplier, a Faraday cup, a microchannel plate, an avalanche photodiode, and the like. Also could have combinations of these pieces like a microchannel plate in front of an avalanche photodiode. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configure the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detected negative ions.

Ion Detector

Figure 2A:
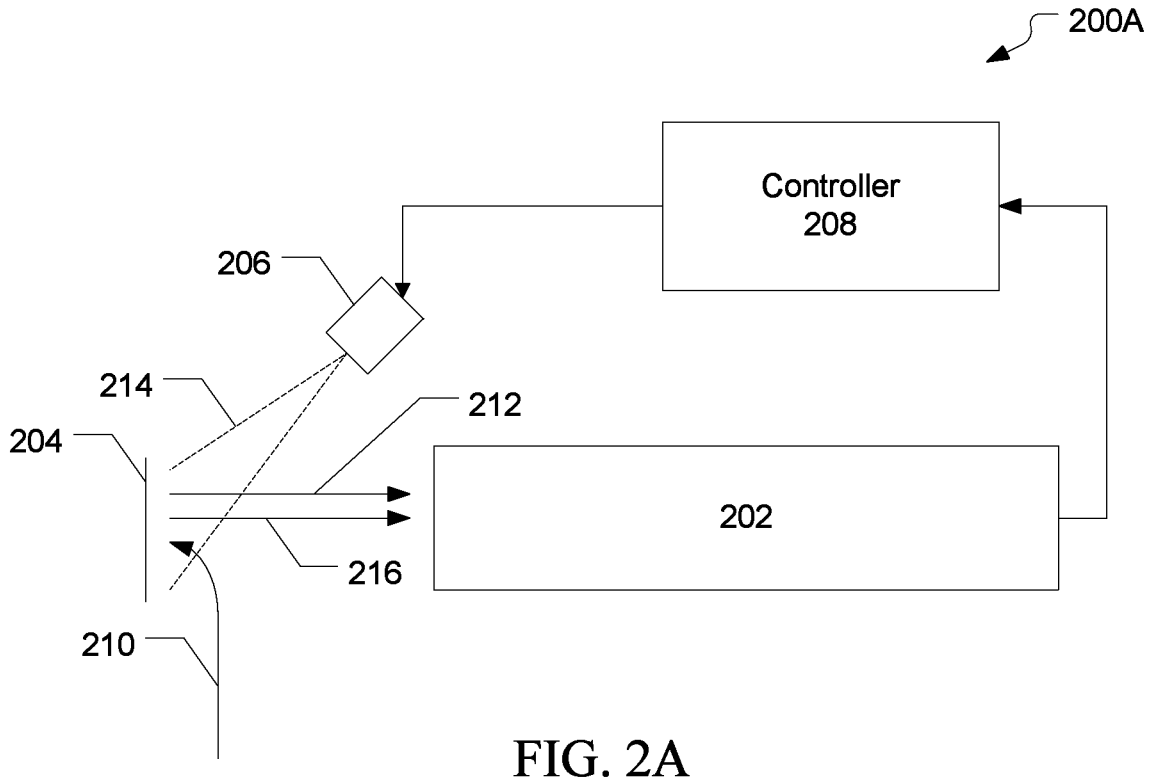
FIGS. 2A and 2B are diagrams illustrating an exemplary detector, in accordance with various embodiments.
Figure 2B:
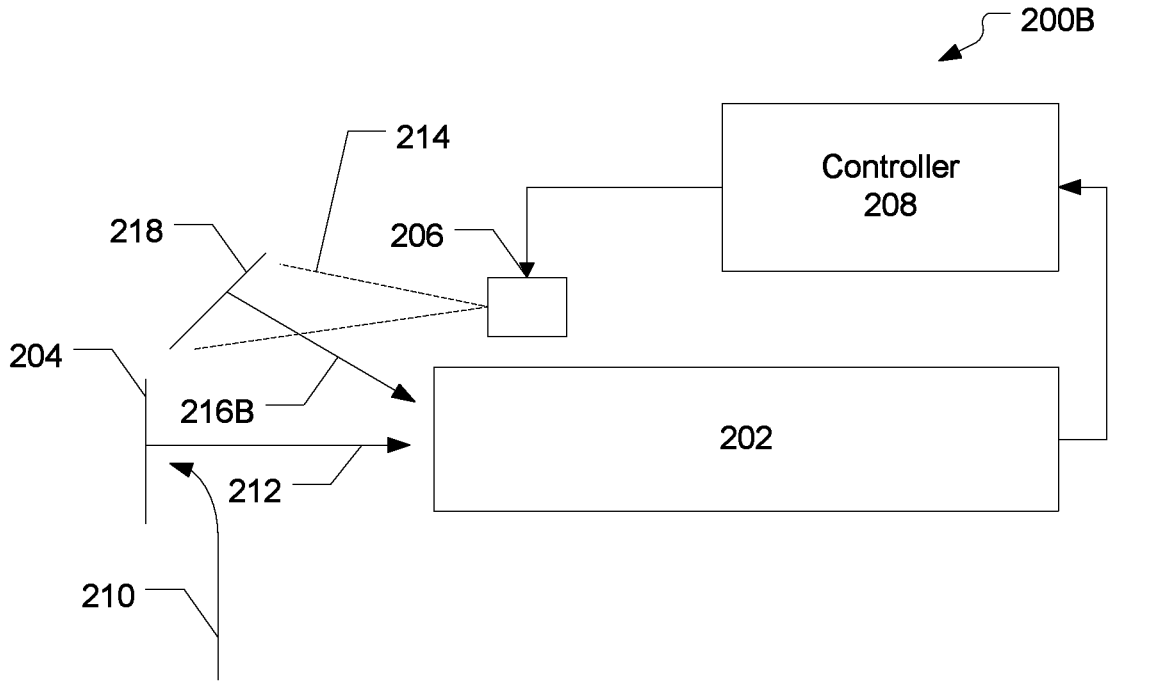

FIG. 2A is a diagram illustrating an ion detector 200A and FIG. 2B is a diagram illustrating an ion detector 200B, both of which can be used as ion detector 106 of mass spectrometry platform 100.

In FIG. 2A, ion detector 200A can include an electron multiplier 202, a first stage dynode 204, a photon emitter 206, and a controller 208. In various embodiments, the photon emitter 206 can be a light emitting diode (LED), such as a UV LED, a laser, a discharge lamp, and the like. When detecting ions from the mass spectrometry platform, an ion beam 210 can strike the first stage dynode 204 causing the first stage dynode 204 to eject electrons 212. The electrons can enter the electron multiplier 202 where the electron multiplier can multiply generate additional electrons, amplifying the signal which can be measured by the controller 208. When calibrating ion detector 200A, photons 214 from photon emitter 206 can strike the first stage dynode 204 causing the ejection of photoelectrons 216, which can be received by the electron multiplier 202. Within the electron multiplier 202, the photoelectrons 216 can behave substantially identically to the electrons 212 allowing the electron multiplier gain to be determined using the known flux of photons.

In FIG. 2B, ion detector 200B can include an electron multiplier 202, a first stage dynode 204, a photon emitter 206, and a controller 208. Additionally, ion detector 200B can include a low work function material 218. In various embodiments, the low work function material 218 can have a work function that is lower than the photon energy. Table 1 shows the correlation between photon wavelength and photon energy and Table 2 shows the work function of exemplary materials. Rather than directing photons to the first stage dynode 204, the photons can be directed to the low work function material 218 which can generate photoelectrons 216B more efficiently than the first stage dynode 204. The photoelectrons 216B generated by the low work function material can be directed to the first stage dynode 204 (not shown) or the electron multiplier 202 and operate the same way as the photoelectrons 216 in FIG. 2A.

TABLE 1

Wavelength of Photons at Various Energies.

| Photon Energy (eV) | Wavelength (nm) |
|---|---|
| 2.0 | 619.9 |
| 2.4 | 516.6 |
| 2.8 | 442.8 |
| 3.0 | 413.3 |
| 3.4 | 364.6 |
| 3.8 | 326.3 |
| 4.2 | 295.2 |
| 4.6 | 269.5 |
| 5.0 | 248.0 |
| 6.0 | 213.8 |

TABLE 2

Work Functions of Various Materials

| Element Symbol | Work Function (eV) |
|---|---|
| Yb | 2.6 |
| Sm | 2.7 |
| Ca | 2.87 |
| Ce | 2.9 |
| Gd | 2.9 |
| Tb | 3 |
| Y | 3.1 |
| Nd | 3.2 |
| Zn | 3.63-4.9 |
| Mg | 3.66 |
| Nb | 3.95-4.87 |
| La | 4 |
| Al | 4.06-4.26 |
| Mn | 4.1 |
| W | 4.32-5.22 |
| Mo | 4.36-4.95 |
| Ti | 4.33 |
| Sn | 4.42 |
| Ag | 4.52-4.74 |
| Cu | 4.53-5.10 |
| Sb | 4.55-4.7 |
| Fe | 4.67-4.81 |
| Re | 4.72 |
| Rh | 4.98 |
| Co | 5 |
| Ni | 5.04-5.35 |
| Pt | 5.12-5.93 |
| Au | 5.1-5.47 |
| Pd | 5.22-5.6 |

In various embodiments, ion detector 200A or 200B can include a photodetector to provide a direct measure of the output of the photon emitter 206. The photodetector can be used to compensate for changes in the emission efficiency of the photon emitter 206 over time, such as by adjusting the current supplied to the photo emitter 206 or factoring the change in emission efficiency into the gain calculation.

Figure 3:
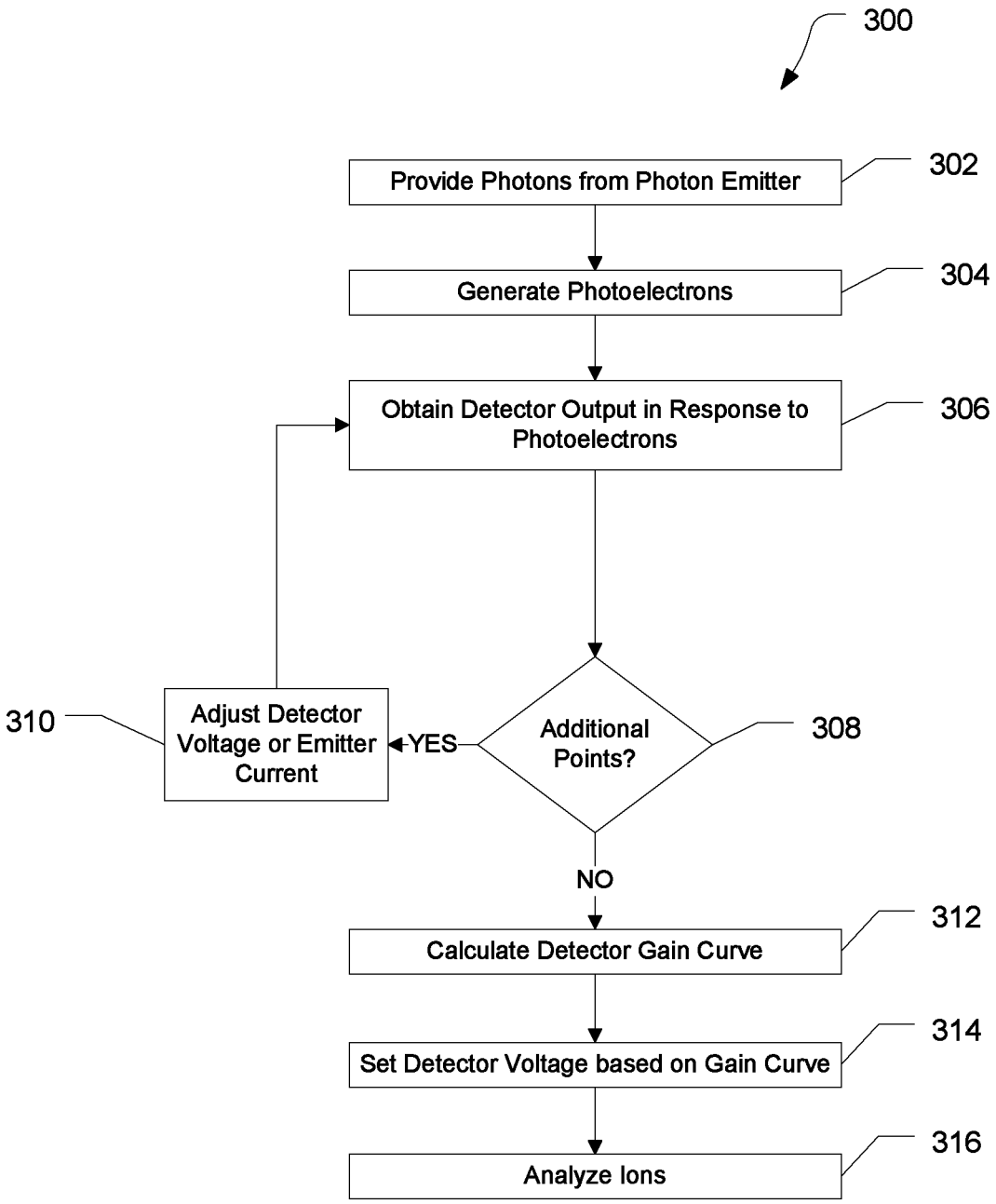
FIG. 3 is a flow diagram illustrating an exemplary method of calibrating an ion detector, in accordance with various embodiments.

FIG. 3 illustrates an exemplary method 300 of calibrating an ion detector. At 302, photons can be provided by a photo emitter. In various embodiments, the photo emitter can be a LED, such as a UV LED. At 304, the photons can strike a low work function material to generate photoelectrons. The low work function material can be incorporated into a first stage dynode of the detector or as a separate component. In various embodiments, the photoelectrons can be directed to an electron multiplier of the detector. At 306, the output of the detector in response to the photoelectrons can be measured. The output can be proportional to the number of photoelectrons released by the low work function material.

At 308, a determination can be made if additional points are needed to calculate the gain curve. When additional points are needed, the detector voltage or the emitter current can be changed, as indicated at 310, and an additional output can be obtained. Alternatively, at 312 when no additional points are needed, the detector gain curve can be calculated.

At 314, the detector voltage can be set based on the calculated gain curve, and at 316, ions can be analyzed.

Computer-Implemented System

Figure 4:
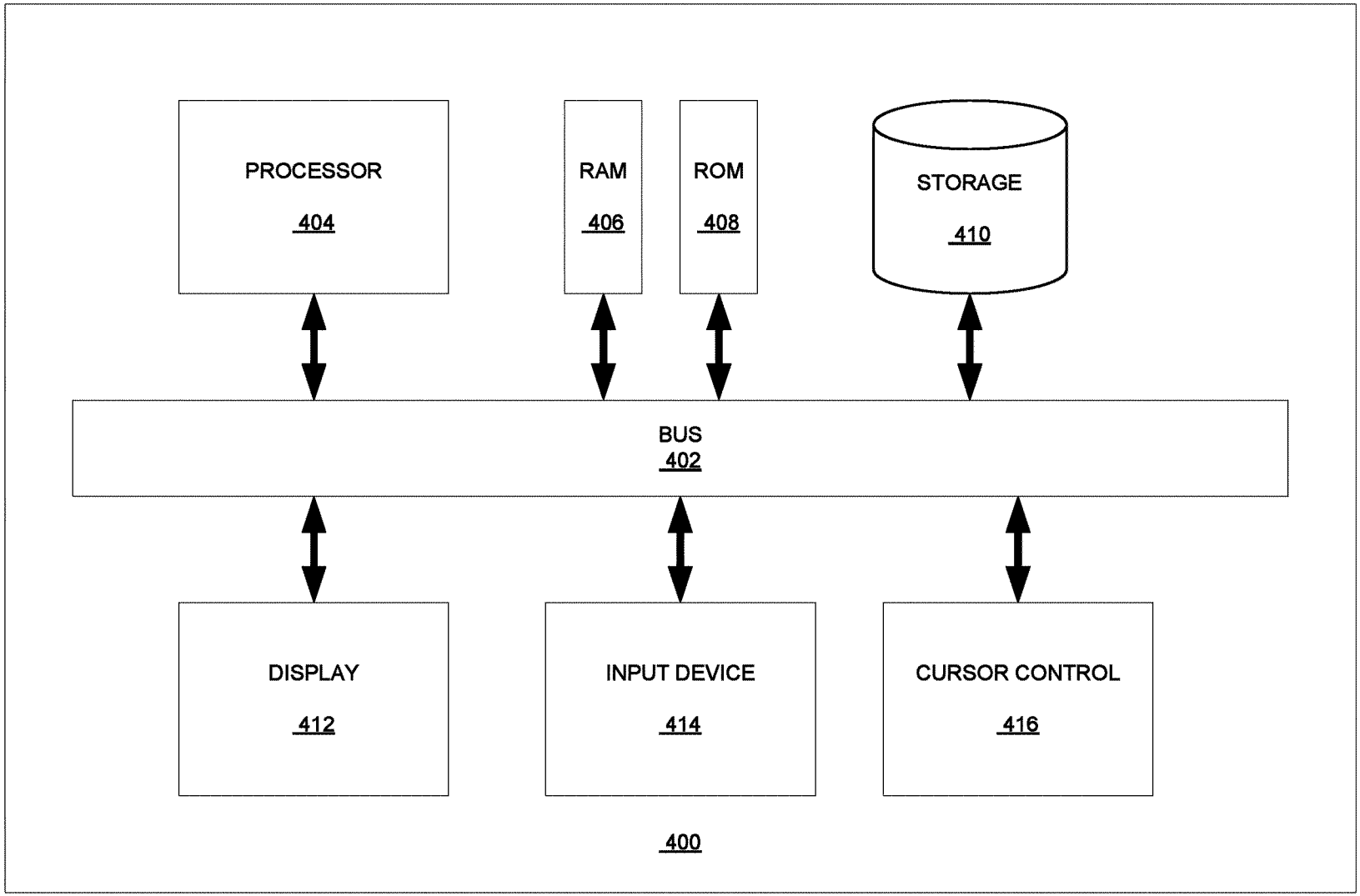
FIG. 4 is a block diagram illustrating an exemplary computer system.

FIG. 4 is a block diagram that illustrates a computer system 400, upon which embodiments of the present teachings may be implemented as which may incorporate or communicate with a system controller, for example controller 108 shown in FIG. 1, such that the operation of components of the associated mass spectrometer may be adjusted in accordance with calculations or determinations made by computer system 400. In various embodiments, computer system 400 can include a bus 402 or other communication mechanism for communicating information, and a processor 404 coupled with bus 402 for processing information. In various embodiments, computer system 400 can also include a memory 406, which can be a random access memory (RAM) or other dynamic storage device, coupled to bus 402, and instructions to be executed by processor 404. Memory 406 also can be used for storing temporary variables or other intermediate information during execution of instructions to be executed by processor 404. In various embodiments, computer system 400 can further include a read only memory (ROM) 408 or other static storage device coupled to bus 402 for storing static information and instructions for processor 404. A storage device 410, such as a magnetic disk or optical disk, can be provided and coupled to bus 402 for storing information and instructions.

In various embodiments, computer system 400 can be coupled via bus 402 to a display 412, such as a cathode ray tube (CRT) or liquid crystal display (LCD), for displaying information to a computer user. An input device 414, including alphanumeric and other keys, can be coupled to bus 402 for communicating information and command selections to processor 404. Another type of user input device is a cursor control 416, such as a mouse, a trackball or cursor direction keys for communicating direction information and command selections to processor 404 and for controlling cursor movement on display 412. This input device typically has two degrees of freedom in two axes, a first axis (i.e., x) and a second axis (i.e., y), that allows the device to specify positions in a plane.

A computer system 400 can perform the present teachings. Consistent with certain implementations of the present teachings, results can be provided by computer system 400 in response to processor 404 executing one or more sequences of one or more instructions contained in memory 406. Such instructions can be read into memory 406 from another computer-readable medium, such as storage device 410. Execution of the sequences of instructions contained in memory 406 can cause processor 404 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations of the present teachings are not limited to any specific combination of hardware circuitry and software.

The term "computer-readable medium" as used herein refers to any media that participates in providing instructions to processor 404 for execution. Such a medium can take many forms, including but not limited to, non-volatile media, volatile media, and transmission media. Examples of non-volatile media can include, but are not limited to, optical or magnetic disks, such as storage device 410. Examples of volatile media can include, but are not limited to, dynamic memory, such as memory 406. Examples of transmission media can include, but are not limited to, coaxial cables, copper wire, and fiber optics, including the wires that comprise bus 402.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

In various embodiments, the methods of the present teachings may be implemented in a software program and applications written in conventional programming languages such as C, C++, etc.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

What is claimed is:

1. An ion detector comprising:

a first stage dynode configured to receive an ion beam and generate electrons;

a photon source arranged to provide photons to the first stage dynode, the photons of sufficient energy to cause the first stage dynode to emit photoelectrons;

an electron multiplier configured to receive the electrons or the photoelectrons from the first stage dynode and generate an output proportional to the number of electrons or photoelectrons; and a controller configured to:

receive the output generated in response to the photoelectrons;

calculate a gain curve of the detector based on the output; and set a voltage of the electron multiplier or the first stage dynode to achieve a target gain for the ion beam.

2. The ion detector of claim 1, wherein the photon source is a light emitting diode, a laser, or a discharge lamp.

3. The ion detector of claim 2, wherein the light emitting diode is an ultraviolet light emitting diode.

4. The ion detector of claim 1, further comprising a photodiode configured to measure the photon output of the photon source.

5. The ion detector of claim 4, wherein the controller is further configured to adjust the current supplied to the photon source in response to the measured photon output.

6. The ion detector of claim 1, wherein the controller is further configured to obtain a second output with a different current supplied to the photon source or a different voltage of the electron multiplier, and the calculated gain curve is further based on the second output.

7. A mass spectrometer comprising the ion detector of claim 1.

8. A method for calibrating an ion detector comprising, providing photons to a material, the photons having sufficient energy to cause the material to emit photoelectrons;

generating an output proportional to the number of photoelectrons using an electron multiplier;

calculating a gain curve for the detector based on the output proportional to the number of photoelectrons;

setting a voltage of the electron multiplier based on the gain curve;

directing an ion beam to a first stage dynode, the ions having sufficient energy to cause the first stage dynode to emit electrons;

obtaining an output from the electron multiplier; and determining a number of ions in the ion beam based on the output from the electron multiplier.

9. The method of claim 8, wherein providing photons to the first stage dynode includes generating photons with a photon source.

10. The method of claim 9, wherein the photon source is a light emitting diode, a laser, or a discharge lamp.

11. The method of claim 10, wherein the light emitting diode is an ultraviolet light emitting diode.

12. The method of claim 8, further comprising measuring the output of the photon source using a photodiode.

13. The method of claim 12, further comprising adjusting the current supplied to the photon source in response to the measured photon output.

14. The method of claim 8, wherein providing the photons to the material includes providing photons to the first stage dynode, the first stage dynode including the material.

15. The method of claim 8, further comprising obtaining a second output with a different current supplied to the photon source or a different voltage of the electron multiplier, wherein calculating the gain curve is further based on the second output.

16. An ion detector comprising:

a first stage dynode configured to receive an ion beam and generate electrons;

a material;

a photon source arranged to provide photons to the material, the photons of sufficient energy to cause the material to emit photoelectrons;

an electron multiplier configured to receive the electrons from the first stage dynode or the photoelectrons from the material and generate an output proportional to the number of electrons or photoelectrons; and a controller configured to:

receive the output generated in response to the photoelectrons;

calculate a gain curve of the detector based on the output; and set a voltage of the electron multiplier or the first stage dynode to achieve a target gain for the ion beam.

17. The ion detector of claim 16, wherein the photon source is a light emitting diode, a laser, or a discharge lamp.

18. The ion detector of claim 17, wherein the light emitting diode is an ultraviolet light emitting diode.

19. The ion detector of claim 16, further comprising a photodiode configured to measure the photon output of the photon source.

20. The ion detector of claim 19, wherein the controller is further configured to adjust the current supplied to the photon source in response to the measured photon output.

21. The ion detector of claim 16, wherein the controller is further configured to obtain a second output with a different current supplied to the photon source or a different voltage of the electron multiplier, and the calculated gain curve is further based on the second output.

22. A mass spectrometer comprising the ion detector of claim 16.

* * * * *